United States Patent [19]

Governale

[11] 3,967,412

[45] July 6, 1976

[54] ADJUSTABLE THRESHOLD

[75] Inventor: Bernard C. Governale, Duluth, Ga.

[73] Assignee: Peachtree Doors, Inc., Norcross, Ga.

[22] Filed: Sept. 17, 1975

[21] Appl. No.: 613,977

[52] U.S. Cl. ..... 49/468
[51] Int. Cl.[2] ..... E06B 1/70
[58] Field of Search ..... 49/468, 467, 469, 470, 49/471

[56] References Cited

UNITED STATES PATENTS

| | | | |
|---|---|---|---|
| 646,465 | 4/1900 | Seely | 49/468 |
| 1,840,879 | 1/1932 | Barringer | 49/468 |
| 2,976,584 | 3/1961 | Ghormley | 49/469 X |
| 3,690,037 | 9/1972 | Kempel | 49/468 X |
| 3,762,100 | 10/1973 | Kempel | 49/468 |

*Primary Examiner*—Philip C. Kannan
*Attorney, Agent, or Firm*—D. Paul Weaver

[57] ABSTRACT

A vertically adjustable threshold member or bar is shipped in a down position and is adjusted upwardly at installation by attached shouldered leveling screws engaging within flared T-nuts of base or sub-structue. A compressible seal is interposed between the outer longitudinal edge of the adjustable threshold member and an extruded metal sill. The outer longitudinal edge of the threshold member is beveled slightly for increasing pressure on seal as threshold member is raised.

8 Claims, 6 Drawing Figures

ADJUSTABLE THRESHOLD

BACKGROUND OF THE INVENTION

Adjustable thresholds are known in the prior art and have for their purpose to compensate for unevenness and lack of squareness in doors and door frames, as well as to provide an improved doorway seal. Some examples of the patented prior art are shown by U.S. Pat. Nos. 3,374,579; 3,690,037 and 3,762,100.

The general objective of this invention is to improve on the prior art adjustable thresholds by rendering them less complicated and therefore less costly and by increasing their efficiency of operation and ease of installation.

Generally, the devices of the prior art have not been widely accepted because of undue complexity and cost and because they are difficult to install and properly adjust and lack the sturdiness of construction required for long service with practically no maintenance. The present invention seeks to overcome these and other deficiencies of the prior art, and various features and advantages of the invention will become apparent during the course of the following description.

BRIEF DESCRIPTION OF DRAWING FIGURES

DETAILED DESCRIPTION

Figure 1:
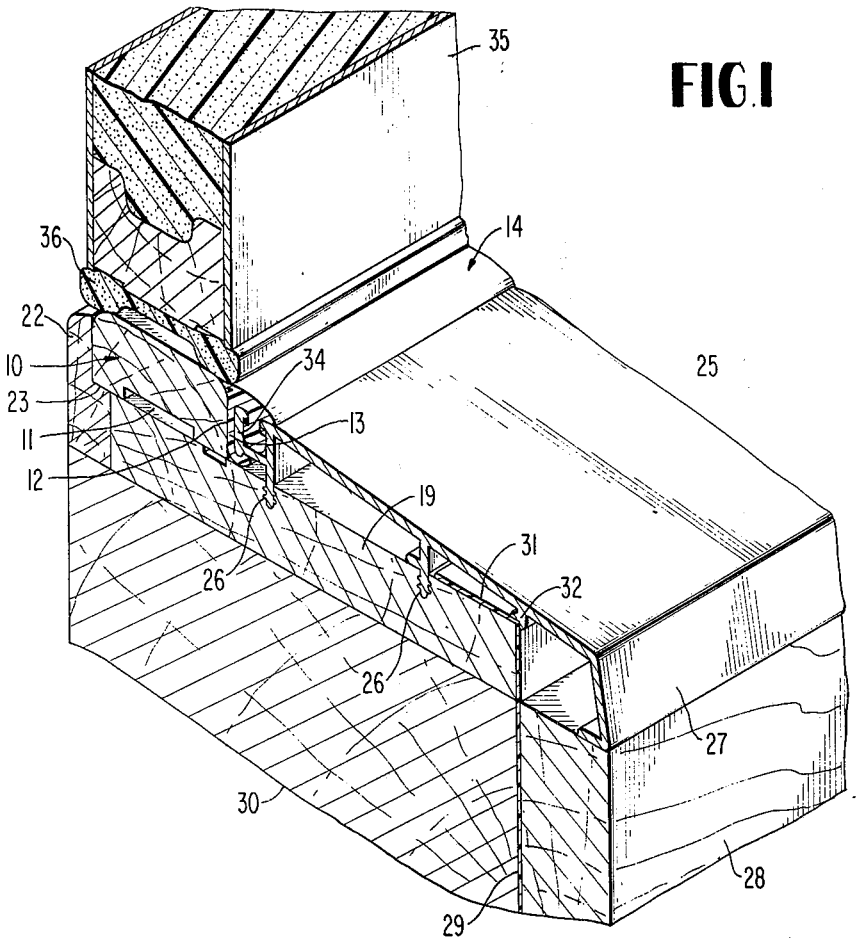
FIG. 1 is a fragmentary perspective view in cross section of an adjustable threshold embodying the present invention.

Referring to the drawings in detail wherein like numerals designate like parts, the adjustable threshold according to the invention comprises a vertically adjustable threshold member or bar 10 preferably formed of hard wood, such as oak. The bar or member 10 has a shallow longitudinal recess 11 in its bottom face for a purpose to be described and is generally rectangular in cross section, as illustrated. However, the outer longitudinal side wall 12 of the adjustable threshold member is inclined slightly from the true vertical to provide a wedging or squeezing action on the longitudinal skirt 13 of an adjacent compressible rubber-like seal 14 as the threshold member 10 is adjusted upwardly.

Figure 2:
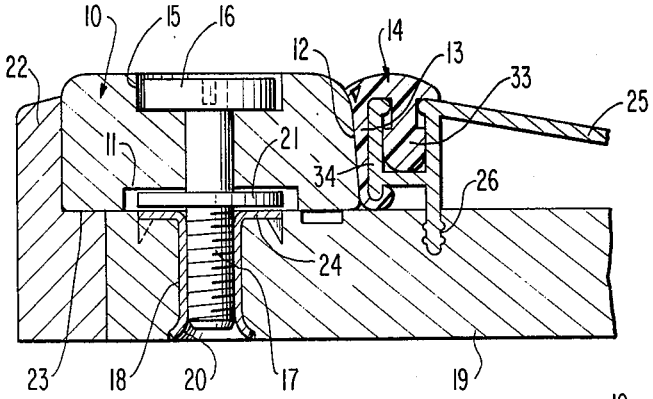
FIG. 2 is an enlarged fragmentary vertical cross section taken through the threshold and showing the adjustable threshold member in a full down position for shipment.
Figure 3:
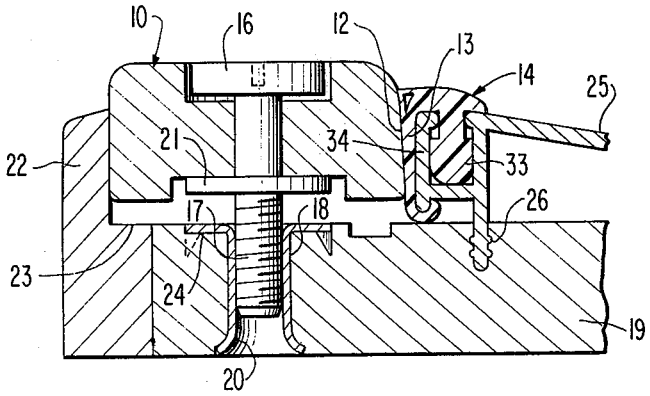
FIG. 3 is a similar sectional view showing the adjustable threshold member in a raised use position.
Figure 4:
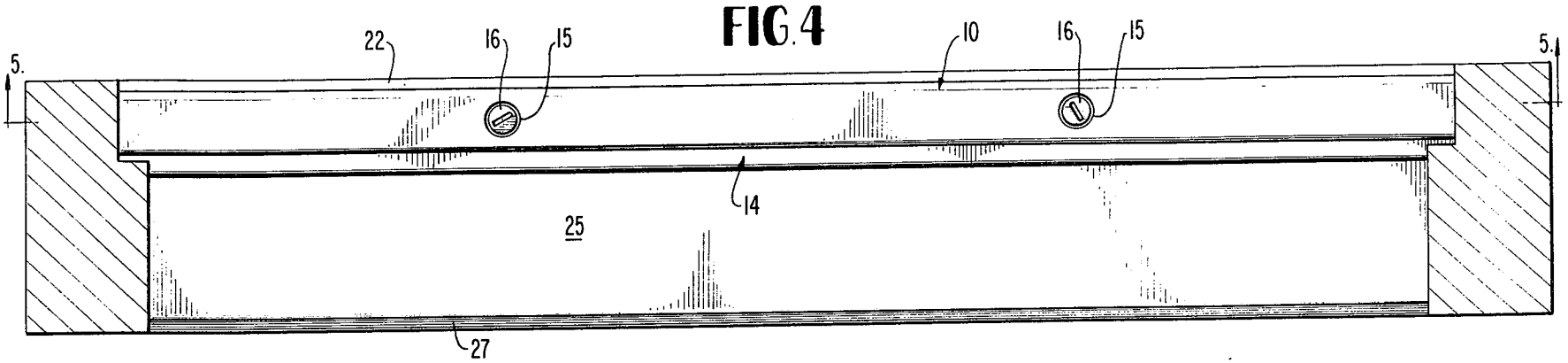
FIG. 4 is a plan view of the invention, partly in section.
Figure 5:
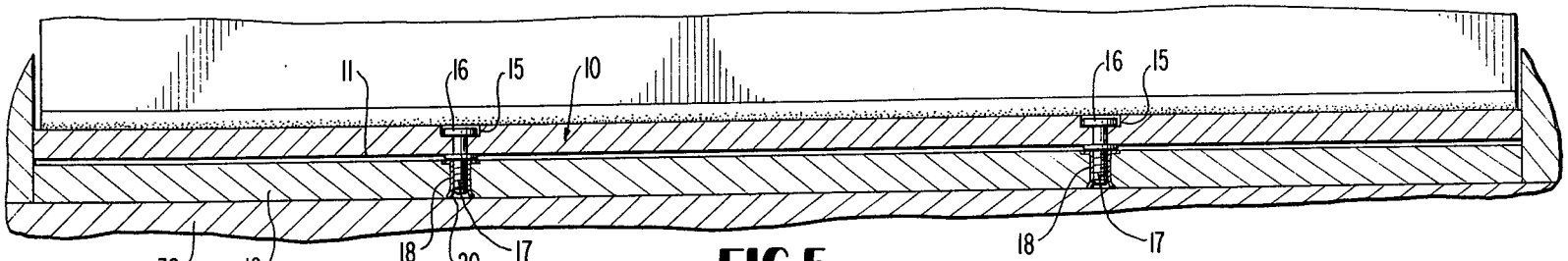
FIG. 5 is a vertical cross section taken longitudinally through the adjustable threshold member and showing the captured adjusting or leveling screws thereof with the threshold member in a down position as in FIG. 2 and taken on line 5—5 of FIG. 4.

The top face of the member 10 is recessed as at 15 to receive the flat heads 16 of adjusting or leveling screws 17, whose threaded shanks are received by T-nuts 18 anchored within openings of a sill filler or base member 19. The screw heads 16 are flush with or slightly below the top face of the adjustable threshold member 10, as shown in FIGS. 2 and 3. The lower ends of the T-nuts 18 are flared at 20 to prevent their retraction from the filler member 19 during the adjustment of the threshold member 10.

The adjusting or leveling screws 17 have intermediate rigid flat plates or washers 21 affixed thereto by welding or the like and these elements are received within the bottom recess 11 of the adjustable member 10 and maintain the screws 17 captive on the member 10 although freely rotatable thereon to allow adjusting with a screwdriver.

A wooden water stop member 22 abuts the interior longitudinal edge of threshold member 10 and also has a horizontal shoulder 23 underlying the member 10, FIGS. 2 and 3. The shoulder 23 is flush with the top face of sill filler 19, FIGS. 2 and 3, and the heads 24 of T-nuts 18 are similarly flush with the top face of member 19. It may be seen that the adjustable threshold member 10 is trapped at all times between the water stop 22, which is a fixed member, and the compressible seal 14.

The adjustable threshold further comprises a preferably extruded aluminum sill 25 having dependent tines 26 which are embedded in the filler member 19 when the threshold is installed. An exterior dependent flange 27 of sill 25 rests on the top edge of a wooden finishing board or strip 28, as shown in FIG. 1. A moisture-proof barrier sheet 29 is preferably intervened between the finishing strip 28 and adjacent base member 30, and a top extension 31 of the barrier sheet is clamped as at 32 between the sill 25 and filler member 19.

The soft compressible seal 14 has a rounded top portion which bridges the space between sill member 25 and adjustable threshold member 10 and also forms a good seal therewith. A dependent body 33 of the compressible seal 14 is held captive in a compartment of the extruded sill 25 near the interior thereof, as shown. The dependent skirt 13 of the seal adjacent to the adjustable member 10 is squeezed between the slightly angled face 12 of the adjustable threshold member and the adjacent fixed vertical web 34 of sill 25.

A horizontally swinging door 35 is shown in FIG. 1 above the adjustable threshold member 10, and equipped with a lower edge seal or weather strip 36 which wipes the member 10 when the door is closed.

When the assembly, consisting of elements 19, 22, 10, 14, 25, 17 and 18, is shipped, the member 10 is preferably in the full down position shown in FIG. 2 for compactness and so that there will be no loose components.

Figure 6:
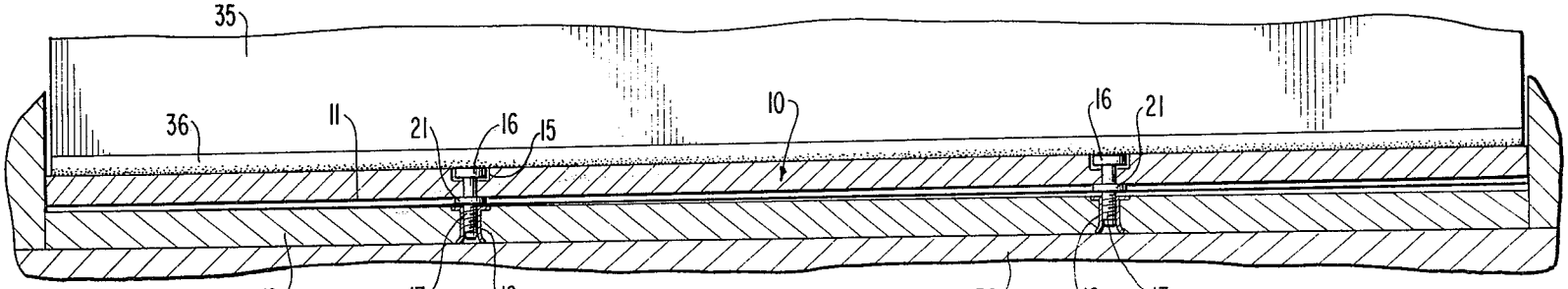
FIG. 6 is a view similar to FIG. 5 showing the threshold member in an adjusted and level position relative to a door.

During installation, however, the leveling screws 17 are utilized as required to raise and level the member 10 so as to compensate for irregularities in the door and doorway. FIG. 6 illustrates the manner in which one of the adjusting screws 17, namely the right hand screw in FIG. 6, may be utilized to raise one end of the member 10 a greater distance above the fixed filler member 19 than the opposite end thereof. In some instances, the reverse may prevail and in still other instances both ends of the member 10 may require adjusting upwardly substantially the same amounts. In this respect, the invention is very versatile and at the same time very simple. The construction is sturdy and there is no possibility for the component parts to be lost during shipment or otherwise separated. Once properly installed and adjusted, the parts will remain properly positioned for years with minimum attention or no attention. The advantages of the invention should now be apparent to those skilled in the art without the necessity for further description herein.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. An adjustable threshold assembly comprising in combination a base member, a sill anchored to the base member and overlying it, a rigid water stop fixed to the base member and spaced from the sill and projecting above the base member, a compressible seal anchored to the sill and above the base member and in opposing spaced relation to said water stop and substantially parallel thereto, an adjustable threshold member disposed between the rigid water stop and said seal and substantially coextensive lengthwise therewith and disposed above the base member and adapted to rest thereon when in a full down position, and plural spaced adjusting and leveling screw devices for said adjustable threshold member carried thereby and having screwthreaded engagement within stationary nut means on said base member underlying said adjustable threshold member.

2. The structure of claim 1, and said screw devices consisting of dependent adjusting screws on said adjustable threshold member, insert nuts on the base member having flared lower ends to resist separation of the nuts from the base member and intermediate washer elements on the shanks of said adjusting screws and spaced from heads of the adjusting screws with the adjustable threshold member permanently secured between said heads and washer elements, whereby the adjusting screws are held captive on the adjustable threshold member while being freely rotatable thereon.

3. The structure of claim 2, and said adjusting screws having smooth unthreaded shanks between said heads and washer elements, the top and bottom faces of the adjustable threshold member being recessed to receive said heads and washer elements in substantially flush relationship with said top and bottom faces.

4. The structure of claim 1, and said adjustable threshold member being a generally rectangular bar-like member and having one longitudinal edge facing said compressible seal disposed at a slight angle to the vertical whereby the seal will be progressively compressed during elevation of the adjustable threshold member.

5. The structure of claim 4, and said compressible seal comprising a body portion anchored within a depressed chamber of said sill, a top portion bridging between said sill and adjustable threshold member, and a longitudinal dependent skirt disposed directly between said angled edge of the adjustable threshold member and an opposing vertical wall of said sill.

6. The structure of claim 5, and said sill comprising an extruded metal sill, said adjustable threshold member formed of hard wood, and said seal formed of rubber-like material.

7. The structure of claim 1, and a flexible moisture-proof sheet element underlying said sill and clamped by the sill against said base member, whereby said sheet element may extend below said base member and between an underlying structural member and an exterior finishing strip attached to the structural member.

8. The structure of claim 2, wherein said insert nuts comprise T-nuts.

* * * * *